United States Patent [19]

Mancel

[11] Patent Number: 4,638,949

[45] Date of Patent: Jan. 27, 1987

[54] DEVICE FOR SPRAYING PRODUCTS, MORE ESPECIALLY, PAINTS

[76] Inventor: Patrick J. Mancel, 3 rue Lamartine, 78500 Sartrouville, France

[21] Appl. No.: 603,662

[22] Filed: Apr. 26, 1984

[30] Foreign Application Priority Data

Apr. 27, 1983 [FR] France ..... 83 06968

[51] Int. Cl.[4] ..... B05B 7/26

[52] U.S. Cl. ..... 239/307; 239/526; 137/625.41; 137/896

[58] Field of Search ..... 239/304, 305, 307, 310, 239/318, 527, 581, 582, 414, 415; 137/625.12, 625.13, 625.15, 625.31, 625.41, 625.46, 896, 846; 251/208; 222/134

[56] References Cited

U.S. PATENT DOCUMENTS

| | | | |
|---|---|---|---|
| Re. 21,873 | 8/1941 | Hermann | 137/898 X |
| 1,090,863 | 3/1914 | Kelly | 137/625.41 X |
| 1,906,975 | 5/1933 | Larson | 239/527 X |
| 2,911,008 | 11/1959 | Du Bois | 137/625.41 X |
| 2,968,474 | 1/1961 | Eichelman et al. | 251/208 X |
| 3,135,467 | 6/1964 | Greenman | 239/304 |
| 3,536,296 | 10/1970 | Barris | 251/208 |
| 4,205,822 | 6/1980 | Boinat | 251/208 |
| 4,243,063 | 1/1981 | Parkison | 137/625.12 X |

FOREIGN PATENT DOCUMENTS

| | | | |
|---|---|---|---|
| 273038 | 7/1962 | Australia | 239/310 |
| 61653 | 10/1939 | Norway | 137/625.41 |

*Primary Examiner*—Andres Kashnikow
*Assistant Examiner*—Kevin Patrick Weldon
*Attorney, Agent, or Firm*—Schiller & Pandiscio

[57] ABSTRACT

This invention describes a hand held paint sprayer that mixes paint products from at least two reservoirs, then combines the mixture with a pressurized gas source for propelling the mixed paint through a nozzle outlet. The spray gun incorporates a regulator for varying the amount of one product with respect to the other between 0% and 100%.

3 Claims, 10 Drawing Figures

DEVICE FOR SPRAYING PRODUCTS, MORE ESPECIALLY, PAINTS

The present invention relates to a device for spraying products, more especially paints.

Present spraying devices are not designed for forming and then projecting mixtures of products, nor, with greater reasons, for causing the proportions of the products in the mixtures to vary.

The present invention proposes filling this gap and, for this, it provides a spraying device which is essentially characterized in that it comprises at least two reservoirs each containing a product to be sprayed, ducts for connecting the reservoir to a chamber formed in a spraying nozzle, regulating means inserted between the ducts and the chamber, these means being provided so as to allow two products to pass so that the amount of one with respect to the other may vary continuously from 0 to 100%, a needle moveable in translation for isolating the chamber from the outside or for connecting thereto and a pressurized gas source for propelling the product or products out of the chamber when this latter is connected to the outside.

In a particular embodiment of the invention, the regulating means are formed by a ring mounted for rotation about a shaft and having on one of its faces a circular shaped recess centered on its axis of rotation, this recess having a depth increasing regularly from a zero value at its ends to a maximum value at its middle part, in permanent communication with the chamber and being able to be brought selectively in front of one or two ducts depending on the angular position of the ring.

It is then sufficient to rotate the ring judiciously about its shaft so as to spray either a single product, or a given mixture of two products.

In the particular embodiment of the invention, the recess has a length such that when the outlet of one duct is in front of its middle part, the outlets of two other ducts are situated just beyond its ends.

Thus, by rotating the ring in one direction or the other, the product arriving at the middle part of the recess may then be mixed either with a second, or with a third product.

It will be further noted that this arrangement also allows three different products to be sprayed individually.

Advantageously, the face of the ring bearing the recess is in sealing contact with an annular piece comprising equidistant bores to which the ducts are connected, these bores having a diameter equal to the width of the groove and being spaced apart about a circle whose radius corresponds to the main radius of the recess.

Because of this annular piece, these ducts may of course be simply and rapidly connected to the recess.

Preferably, the nozzle comprises a cavity permanently connected to an additional reservoir and selectively to the chamber when the needle moves beyond its position in which it connects the chamber with the outside.

Thus, with this arrangement, an additional product can be added to the product or to the mixture of products present in the chamber.

In another embodiment, the spraying device in accordance with the invention is characterized in that the ducts each comprise a section having a bore formed in a cylindrical body, perpendicularly to the axis thereof, and in that the regulating means comprise rods engaged in channels connecting one of the transverse faces of the cylindrical body to the bores formed therein, and means for moving the rods between a first endmost position in which they are outside the bore at which the corresponding channel ends and a second endmost position in which they completely close off said bore, these means allowing one of the rods to be in its first endmost position when the others are in their second endmost position or two of them to be in an intermediate position between their two endmost positions.

Preferably, the rods are perpendicular to the bores and are spaced apart about a circle centered on the axis of the cylindrical body, the means for moving the rods comprising a circular cam surface against which said rods are urged resiliently and which is interlocked for rotation with a control plate applied against said transverse face of the cylindrical body, the cam surface being formed by a depression having a depth increasing from a zero value at its ends to a maximum value at its middle part, and a length such that, when one of the rods is in front of its middle part, two other rods are situated just beyond its ends.

It will be noted here that the products to be sprayed do not come into contact with the cam surface, which greatly facilitates cleaning of the device.

Advantageously, the cam surface is situated on the outer face of an annulus disposed in the cavity formed in the face of the plate which is turned towards the cylindrical body.

The composition and the quantity of the mixture could of course be modified by using an annulus whose cam surface has another profile.

It may further be desirable for the annulus to have on its other face two opposite protuberances at equal distances from the middle part of the depression, adjusting means being provided for causing the annulus to pivot at the level of its protuberances.

With this arrangement, the amount of each of the products arriving in the chamber formed in the spray nozzle may in fact be modified, which provides an additional control of the flow rate of the spraying device.

Preferably, the adjusting means comprise a threaded rod screwed into the plate, perpendicularly to the annulus, one of the ends of this threaded rod bearing against said other face of the annulus, at the middle part of the depression, whereas its other end is provided with a control head situated outside the plate.

One advantageous feature is that the ducts comprise a non return valve in their part included between the cylindrical body and the chamber formed in the spraying nozzle. Thus the risk of a product contained in a reservoir under pressure being accidentally driven back into the ducts of the other products is completely removed.

Three embodiments of the present invention will be described hereafter by way of examples which are by no means limitative with reference to the accompanying drawings in which.

Figure 1:
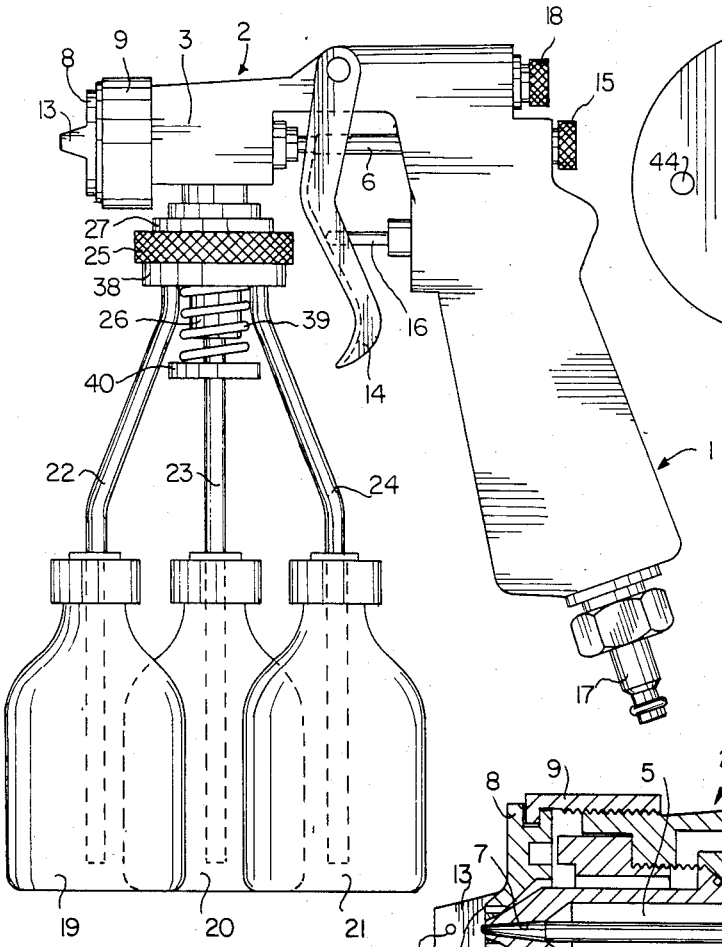
FIG. 1 is a schematical elevational view of a spraying device according to the invention.

The spraying device which is shown in FIG. 1 comprises, in a way known per se, a body having the shape of a handle whose upper part is extended forwardly by a spraying head 2.

Figure 2:
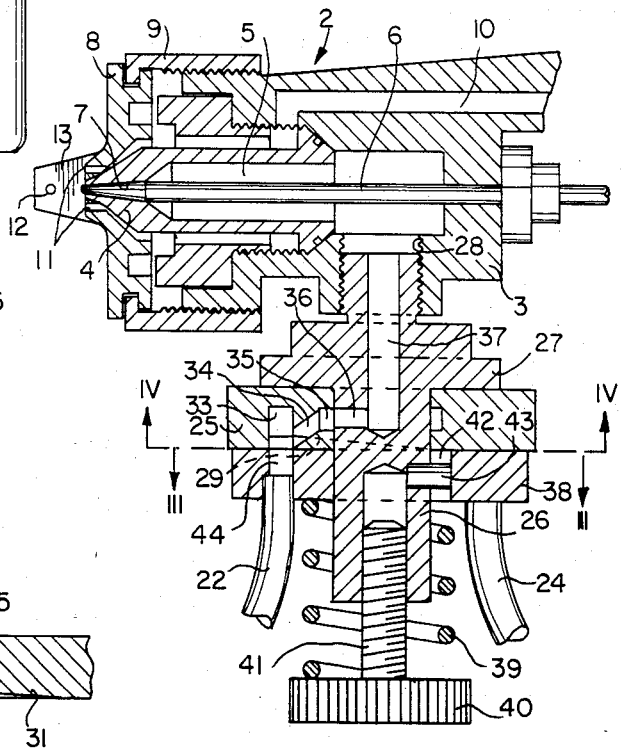
FIG. 2 is an enlarged sectional view of the spraying head of the device shown in FIG. 1.
Figure 4:
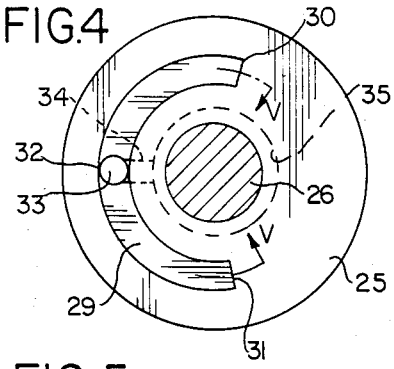
FIG. 4 is a sectional view along line IV—IV of FIG. 2.

The spraying head, whose internal structure is shown in FIG. 2 comprises a body 3 inside which is screwed a spraying nozzle 4, a chamber 4 formed in nozzle 4, a needle 6 moveable in translation in chamber 5 so as to close or to close off to a greater or lesser degree the outlet orifice 7 of the nozzle, a diffuser 8 covering the front end of the nozzle, a ring 9 for mounting the diffuser on the front end of body 3, this ring being screwed thereon, and a duct 10 for feeding a compressed gas, preferably air, to the orifices 11 formed in the diffuser, as well as to orifices 12 formed in two diametrically opposite projections 13 provided on the front face of the diffuser.

As shown in FIG. 1, needle 6 passes sealingly through the rear end of body 3, extends into the space formed between the spraying head 2 and handle 1 and in which it is connected to a control trigger 14, then extends inside the handle to end in an external knurled wheel 15 for adjusting its travel.

In FIG. 1 can also be seen a finger 16 bearing against trigger 14, this finger being intended to control the passage of the compressed gas between the intake connection 17 provided at the lower end of handle 1 and the duct 10 formed in the spraying head 2. A knurled wheel 18 is further provided for adjusting the flow rate of the gas flowing in duct 10.

In the example shown in FIGS. 1 and 2, the spraying device comprises three reservoirs 19, 20, 21 each containing a product to be sprayed, ducts 22, 23, 24 for connecting each of the reservoirs to chamber 5 and regulating means 25 inserted between the ducts and the chamber, these means being adapted for allowing two products to pass selectively so that the amount of one with respect to the other may vary continuously between 0 and 100%.

The regulating means 25 are formed by a ring mounted for rotation on a cylindrical extension 26 provided on a piece 27 screwed into a tapping 28, which is formed in the lower part of the body of the spraying nozzle 2 and communicates with chamber 5.

Figure 3:
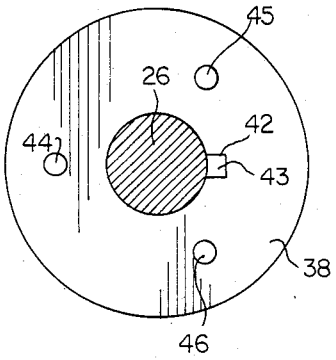
FIG. 3 is a sectional view along line III—III of FIG. 2.
Figure 5:
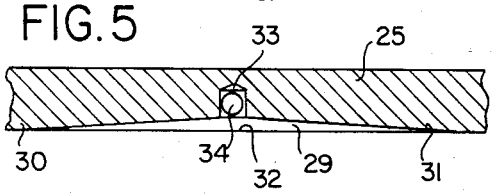
FIG. 5 is a sectional view along line V—V of FIG. 4.

The regulating ring has on its face which is opposite chamber 5, a circular shaped recess 29 centered on the axis of extension 26 (see FIG. 3). This recess has a depth which, as can be seen in FIG. 5, increases regularly from a zero value at its two ends 30, 31 to a maximum value at its middle part 32. Furthermore, it communicates through a blind bore 33 and a radial channel 34 with an annular groove 35 formed in the internal periphery of ring 25, this groove communicating with the chamber 5 through two channels 36, 37 formed in piece 27, one radially and the other axially.

The face of ring 25 in which recess 28 is formed is in sealing contact with an annular piece 38 fitted on the extension 26, this piece being urged against ring 25 by a helical spring 39 bearing thereagainst and against a disk 40 integral with a threaded rod 41 screwed into extension 26. By screwing in rod 41 to a greater or lesser extent the force with which spring 39 urges piece 38 against ring 25 may of course be adjusted.

The annular piece 38 comprises on its internal periphery an axial notch 42 in which is engaged a stud 43 fitted into a radial bore of extension 26. It may thus always occupy the same position with respect to extension 26.

Piece 38 further comprises three equidistant bores 44, 45, 46 having a diameter equal to the width of recess 29, these bores being spaced apart about a circle whose radius corresponds to the mean radius of said recess 29 and being connected respectively to ducts 22, 23, 24.

Referring again to recess 29, it will be noted that its length is such that when one of bores 44, 45, 46 is in front of its middle part 32, the other two are situated just beyond its ends 30 and 31.

For the sake of completeness, it will be mentioned that ring 25 and piece 38 comprise advantageously a slider and a graduation on their external periphery, which allows their relative position to be accurately adjusted and consequently the proportions of the products to be sprayed.

With the spraying device which has just been described, either a single one of the three products contained in reservoirs 19, 20, 21 or a mixture of two of these products may be projected. When the device is used for projecting a mixture of two products, it further allows the proportions thereof in the mixture to be adjusted at will. It is in fact sufficient in this case to position ring 25 judiciously with respect to piece 38 for the products to arrive in chamber 5 in the desired proportions.

The products are propelled out of chamber 5 in a conventional way because of the depression created by the pressurized gas in front of the spraying nozzle 4.

Figure 6:
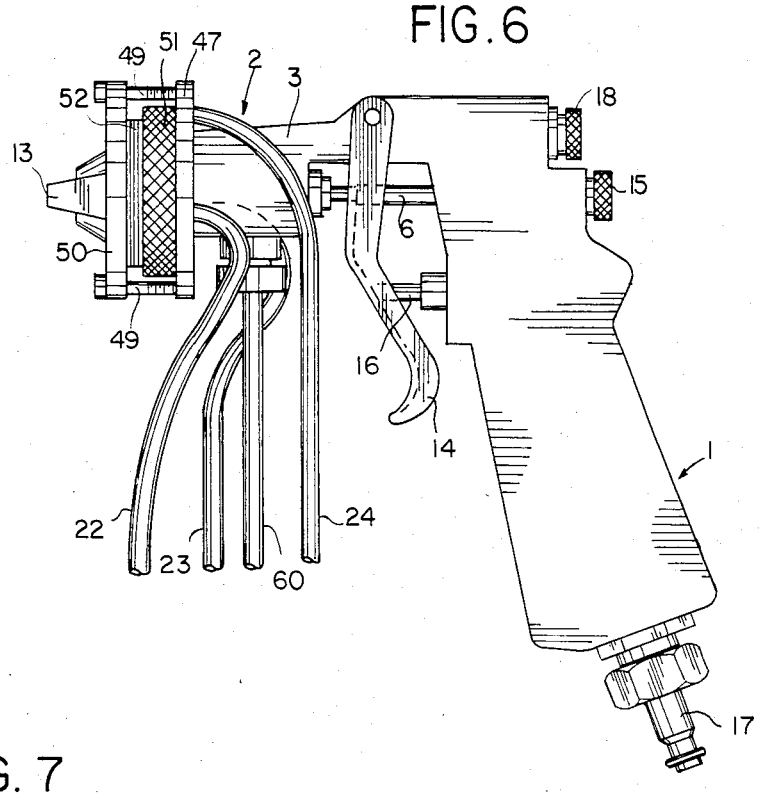
FIG. 6 is a schematical and partial elevational view of a second spraying device in accordance with the invention.

The spraying device shown in FIGS. 6 and 7 comprises members which have already been described with reference to FIGS. 1 to 5 and which will therefore not be described again. Furthermore, they will be designated with the same references used for the embodiments shown in FIGS. 1 to 5.

The head 3 of the spraying device comprises on its front face an external collar 47 having two diametrically opposite tappings 48 into which are screwed the free ends of two screws 49 bearing against an annulus 50 provided for retaining diffuser 8 on the front end of the spraying nozzle 4.

The regulating means 51 are now situated about the spraying nozzle 4, between collar 47 and annulus 50. A resilient device 51*a* of a conventional type is moreover inserted between diffuser 8 and the regulating means 51 so as to ensure a sealing contact between these latter and collar 47.

The regulating means 51 are formed by a rotary ring whose structure is very similar to ring 25 of the embodiment described with reference to FIGS. 1 to 5. This ring comprises in fact on its face which is turned towards collar 47, a circular shaped recess 52 centered on the axis of nozzle 4 and having a depth which increases regularly from a zero value at its ends to a maximum value at its middle part, and communicating through a radial blind bore 53 and an annular groove 54 formed in its internal periphery with a channel 55 extending radially into the nozzle as far as into chamber 5.

As for collar 47, it comprises three equidistant bores 56 (only one of which is shown) having a diameter equal to the width of recess 52, these bores being spaced apart about a circle whose radius corresponds to the mean radius of recess 52 and being connected respectively to the three ducts 22, 23, 24.

Figure 7:
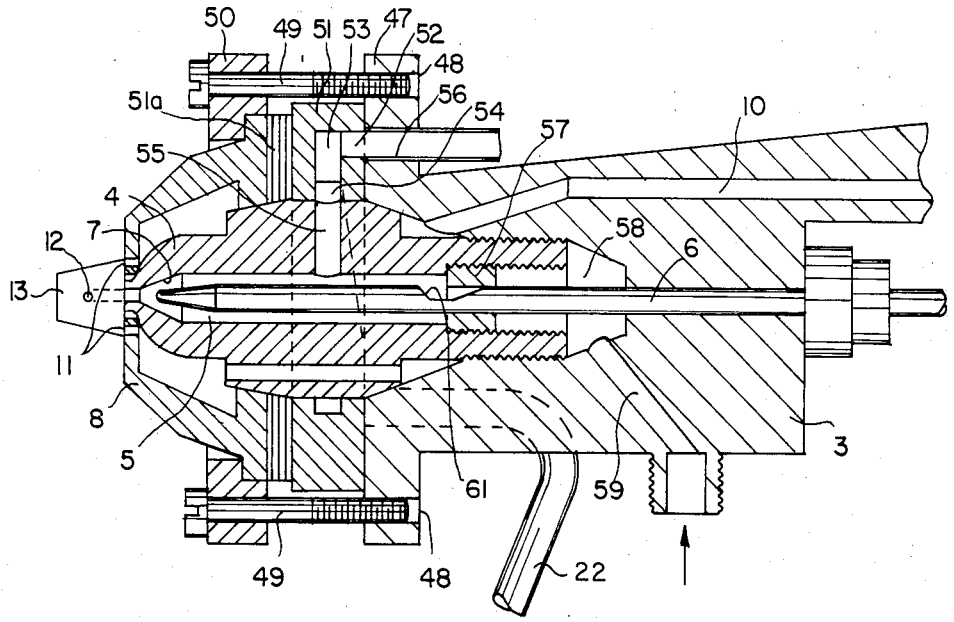
FIG. 7 is an enlarged sectional view of the spraying head of the device shown in FIG. 6.

As can be seen in FIG. 7, needle 6 passes through a threaded socket 57 separating chamber 5 from a cavity 58 connected by a channel 59 formed in body 3 to a duct 60 ending in an additional reservoir not shown.

At the level of socket 57, the needle comprises a whistle shaped notch 61 by means of which it may connect cavity 58 with chamber 5 when it is moved rearwardly, beyond the position in which it opens the outlet orifice 7 of nozzle 4.

When the additional reservoir contains a fourth product, it is then possible, by operating trigger 14 sufficiently, to add another product to the product or to the mixture of products arriving in chamber 5 from recess 52.

Of course, the flow of the additional product will be all the greater the more needle 6 is retracted.

The adjustment of ring 51 is identical to that of ring 25 of the embodiment described with reference to FIGS. 1 to 5 and does not need to be described here.

Figure 8:
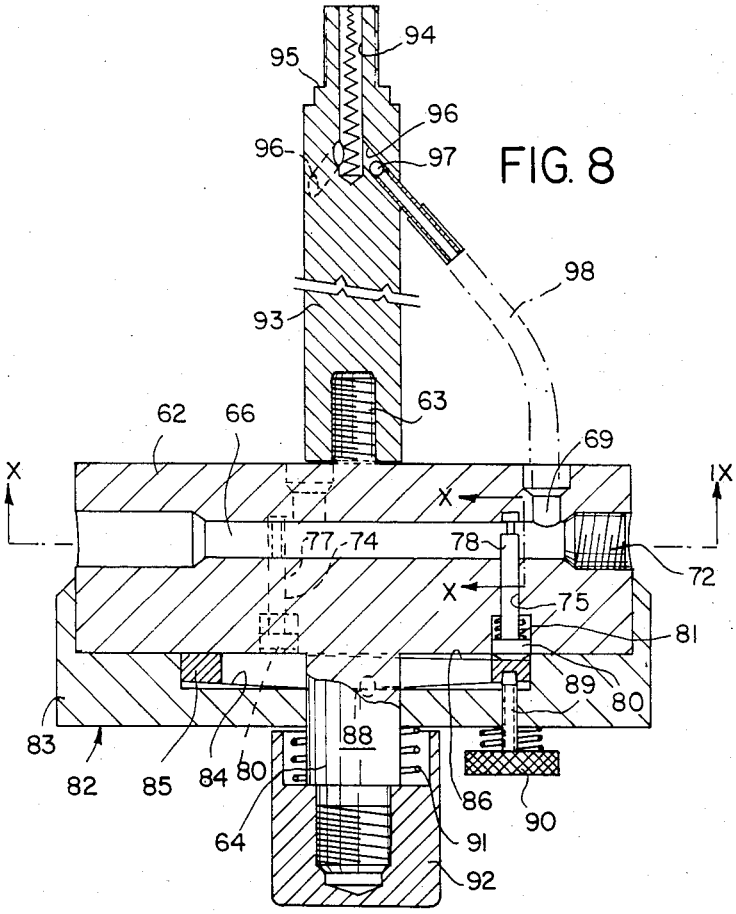
FIG. 8 is a partial sectional view of an assembly which may be fitted to the spraying head of the spraying device shown in FIG. 1.

The assembly shown in FIG. 8 has been designed to be screwed into tapping 28 formed in the lower part of body 3 of the spraying nozzle 2 of the device shown in FIG. 1.

It comprises first of all a cylindrical body 62 whose upper face comprises an axial extension 63 threaded over the whole of its length and whose lower face comprises an axial extension 64 threaded only over a short length from its free end.

In a plane perpendicular to its axis, the cylindrical body comprises three parallel bores 65, 66, 67, bores 65 and 67 being symmetrical with respect to bore 66 which passes through the center of the cylindrical body.

Figure 9:
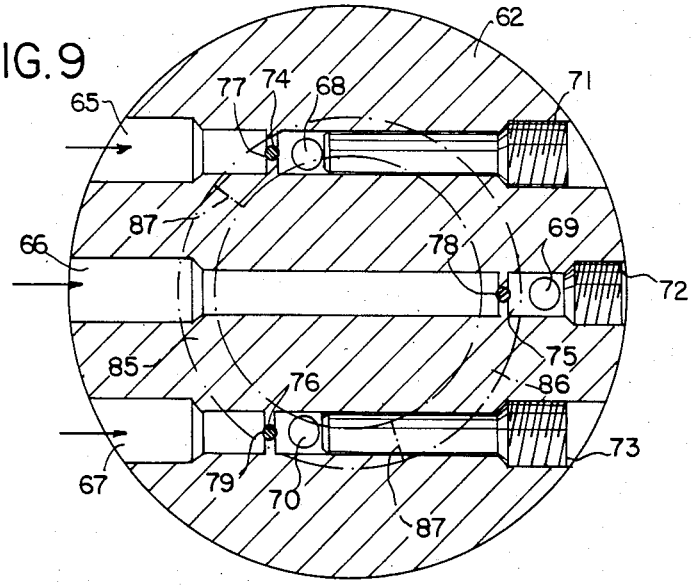
FIG. 9 is a sectional view along line IX—IX of FIG. 8.

Bores 65, 66, 67 communicate with other bores 68, 69, 70 opening on the upper face of the cylindrical body 62 and are closed at their end situated on the right hand side in FIGS. 8 and 9 by plugs 71, 72, 73 whose inner ends extend as far as the immediate vicinity of bores 68, 69, 70.

The cylindrical body also comprises three equidistant channels 74, 75, 76 connecting bores 65, 66, 67 to its lower face. The channels are spaced apart about a circle centered on the axis of the cylindrical body 62 and each comprise a widened part at their end situated on the lower face side of the cylindrical body.

Figure 10:
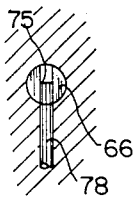
FIG. 10 is a sectional view along line X—X of FIG. 8.

Referring more particularly to FIGS. 9 and 10, it will be noted that bores 65, 66, 67 each comprise a narrow portion forming a slit situated in the extension of the corresponding channel.

Rods 77, 78, 79 slideably housed in channels 74, 75, 76 are provided for closing off bores 65, 66, 67. They comprise a head 80 at their end situated on the lower face side of the cylindrical body 62 and are surrounded by a spring 81 extending between their head 80 and the bottom of the widened part of the corresponding channel.

Means 82 are provided for moving each of the rods, against the action of their spring, between a first endmost position in which they are out of the bore at which the channel which receives them ends and a second endmost position in which they completely close off said bore.

In the embodiment shown in FIGS. 8 and 9, means 82 comprise a cylindrical control plate 83 applied against the lower face of the cylindrical body 62. Plate 83 is fitted onto extension 64 which serves as axis of rotation and comprises on its upper face a cylindrical cavity 84 coaxial with the axis of the cylindrical body.

Means 82 also comprise an annulus 85 disposed in cavity 84 and whose mean radius corresponds to the radius of the circle on which rods 77, 78, 79 are situated.

On its face turned towards the cylindrical body 62, annulus 85 comprises a cam surface 86 which is formed by a depression having a depth increasing from a zero value at its ends 87 to a maximum value at the level of its middle part, and a length such that, when one of rods 77, 78, 79 is in front of its middle part, the other two rods are situated just beyond its ends. For example, when the head of rod 8 is against the middle part of the cam surface 86, bore 66 is open whereas bores 65 and 67 are closed off by rods 77 and 79.

If plate 83 is now slightly rotated so as to bring the cam surface into the position shown with dash dot lines in FIG. 9, rods 77 and 78 open bores 65, 66, the first one not very much and the second one practically entirely.

On its face turned towards the bottom of cavity 84, annulus 85 comprises two opposite protuberances 88 at equal distances from the middle part of its cam surface 86. These protuberances allow it to pivot under the control of a threaded rod 84 screwed into plate 83, one of the ends of this rod bearing against the lower face of annulus 85, at the level of the middle part of its cam surface, whereas its other end is provided with a control head 90 situated under the plate.

By turning the control head 90, ring 85 can be caused to pivot with respect to its protuberances 88 and the position of the upper ends of rods 77, 78, 79 can consequently be adjusted, that is to say the passage section in bores 65, 66, 67.

For the sake of completeness, it may be mentioned here that plate 83 is applied against the lower face of the cylindrical body 62 by a helical spring 91 surrounding the extension 64, this spring being compressed between the lower face of plate 83 and a cap 92 screwed onto the free end of extension 64.

The assembly shown in FIG. 8 also comprises a removable head 93 whose lower end is screwed onto the extension 63 of the cylindrical body 62 and whose upper end comprises a threaded portion adapted for cooperation with the tapping 28 in the body of the spraying nozzle 2 shown in FIG. 2.

The upper end of head 93 comprises a cylindrical prechamber 94 containing a wire 95 wound in the form of an upwardly turned cone, whose bottom communicates with the outside through three oblique bores 96 each comprising a non return valve 97 mounted so as to prohibit any flow from the prechamber towards the outside.

For spraying a product or a mixture of products with the assembly shown in FIG. 8, this assembly is fitted to the nozzle 2 of the spraying device shown in FIGS. 1 and 2 and bores 68, 69 70 of the cylindrical body 62 are connected to the oblique bores 96 of the removable head 93 by means of pipes 98, made preferably from a flexible material, the open ends of bores 65, 66, 67 of the cylindrical body 62 are connected to product reservoirs such as those shown at 19, 20, 21 in FIG. 1, by means of pipes (not shown) made preferably from a flexible material, the position of the annulus 85 is adjusted by means of the control head 90 so as to give a given value to the flow of products flowing through bores 65, 66, 67, the angular position of plate 83 is adjusted so as to obtain the desired proportion of products arriving in chamber 5 of the spraying nozzle 4, and trigger 14 is actuated so as to spray the product or mixture of products contained in chamber 5.

It will be noted here that wire 95 disposed in prechamber 94 facilitates the mixing of the products coming into this latter.

It will also be noted that, by separating the cylindrical body 62 from the removable head 93 and by using sufficiently long pipes for connecting the reservoirs to bores 65, 66, 67 on the one hand and bores 68, 69, 70 to the prechamber 94 on the other, the flow rates and proportions of the products sprayed by the device shown in FIGS. 1 and 2 may be remotely modified.

In spraying devices in accordance with the invention which have just been described may for example be used for spraying paint of different colors, either independently of each other, or by mixing them in very varied proportions. They may moreover be used for forming lap-dissolves or cross-fades by rotating the regulating ring during spraying, so as to apply layers of paints of particular colors on certain parts of objects to be painted.

They could also be used in other fields than painting, such for example as spraying insecticides or weed killers.

I claim:

1. A device for spraying a fluid mixture of one or more fluid components, said device comprising:

spray nozzle means comprising (a) a chamber for containing said mixture and (b) an aperture through which said mixture can be sprayed from said device;

a plurality of reservoirs, each for containing a corresponding one of said components;

a plurality of duct means for respectively connecting said plurality of reservoirs to said chamber;

regulating means connected to said duct means between each of said reservoirs and said chamber for selecting the relative amounts of said components provided from said reservoirs through said duct means to said chamber, said regulating means comprising a regulating element mounted for rotation about a rotation axis and including a surface disposed transversely to said axis, said surface having an arcuate-shaped recess extending at least partially around and radially spaced from said axis and adapted to communicate with at least one of said duct means, said recess being flush with said surface at the opposite ends of said recess and of a maximum depth at the middle part of said recess so that the depth of said recess varies such that rotation of said regulating element varies the amount of at least one of said components relative to at least one other of said components provided from the corresponding reservoirs through said recess and at least two of said duct means to said chamber wherein the arcuate length of said recess is such that positioning said regulating element so that one of said duct means communicates with said middle part of said recess, closes the other of said duct means;

needle valve means including a needle disposed in said nozzle means and movable between a first position wherein said needle blocks said aperture and thereby isolates said chamber from said aperture, and a second position wherein said needle is spaced from said aperture so that said chamber is open to said aperture; and means for coupling said device to a source of pressurized gas so as to propel said mixture from said chamber to said aperture when said needle is disposed in said second position.

2. The device according to claim 1, wherein said regulating means includes an annular element mounted on said axis in sealing contact with said surface of said regulating element, said annular element comprising a plurality of apertures equiangularly equidistantly spaced about said axis, wherein each of said apertures are connected to a corresponding one of said duct means, said apertures having a diameter equal to the width of the recess and being spaced apart over a circle whose radius corresponds to the mean radius of the recess.

3. The device according to claim 1, wherein said nozzle means further comprises a cavity connected to an additional reservoir and said needle is also movable between said second position and a third position wherein said additional reservoir is in fluid communication with said chamber.

* * * * *